US011858770B2

(12) United States Patent
Bae

(10) Patent No.: US 11,858,770 B2
(45) Date of Patent: Jan. 2, 2024

(54) APPARATUS FOR SUPPLYING FILM

(71) Applicant: NPS CO., LTD., Cheongju-si (KR)

(72) Inventor: Seong Ho Bae, Daejeon (KR)

(73) Assignee: NPS CO., LTD., Cheongju-si (KR)

( * ) Notice: Subject to any disclaimer, the term of this patent is extended or adjusted under 35 U.S.C. 154(b) by 250 days.

(21) Appl. No.: 17/233,416

(22) Filed: Apr. 16, 2021

(65) Prior Publication Data

US 2021/0323781 A1 Oct. 21, 2021

(30) Foreign Application Priority Data

Apr. 19, 2020 (KR) ..... 10-2020-0047099
Apr. 15, 2021 (KR) ..... 10-2021-0049385

(51) Int. Cl.
*B65H 3/56* (2006.01)
*B65H 3/08* (2006.01)
*B65H 3/06* (2006.01)

(52) U.S. Cl.
CPC ..... *B65H 3/56* (2013.01); *B65H 3/0607* (2013.01); *B65H 3/0638* (2013.01);
(Continued)

(58) Field of Classification Search
CPC ... B65H 3/32; B65H 3/56; B65H 3/34; B65H 3/48; B65H 2301/3324; B65H 2301/33216
See application file for complete search history.

(56) References Cited

U.S. PATENT DOCUMENTS 6,467,895 B1 * 10/2002 Burns ..... B65H 5/12 400/582

FOREIGN PATENT DOCUMENTS

CN 203450846 U * 2/2014
CN 203450846 U 2/2014
(Continued)

*Primary Examiner* — Patrick Cicchino
(74) *Attorney, Agent, or Firm* — Bridgeway IP Law Group, PLLC; Jihun Kim

(57) ABSTRACT

Disclosed is a film feeding apparatus including a turntable including a driving member and a rotation bar having a central part shaft-coupled to a rotating shaft of the driving member to be driven to rotate around the rotating shaft and driven to rotate to repeatedly perform an operation in which the rotation bar rotates by a predetermined reference angle through the driving member and is then stopped for a predetermined reference time, a film tray that is installed in a predetermined first operation region to position one of opposite ends of the rotation bar on the film tray in a state in which the rotation bar is stopped for the reference time and on which a plurality of films are located in multiple layers, gripping units coupled to the opposite ends of the rotation bar, respectively, to transfer the films along a predetermined circular trajectory around the rotating shaft by the rotation bar and provided to grip the films, and a film ejection unit that is installed in a predetermined second operation region to position a remaining end opposite to the one end of the opposite ends of the rotation bar in the film ejection unit in the state in which the rotation bar is stopped for the reference time and provided to eject the films to an outside, wherein, in the state in which the rotation bar is stopped for the reference time, a griping unit positioned in the first operation region among the gripping units grips a film from the film tray, and a gripping unit positioned in the second operation region among the gripping units releases a film that is pre-gripped from the film tray and transfers the film to the film ejection unit.

12 Claims, 12 Drawing Sheets

(52) U.S. Cl.
CPC . *B65H 3/0816* (2013.01); *B65H 2301/33224* (2013.01); *B65H 2301/42344* (2013.01); *B65H 2402/35* (2013.01); *B65H 2404/1115* (2013.01); *B65H 2405/1113* (2013.01)

(56) References Cited

FOREIGN PATENT DOCUMENTS

| | | | | | |
|---|---|---|---|---|---|
| CN | 204607138 | U | | 9/2015 | |
| CN | 110614799 | A | | 12/2019 | |
| DE | 19855156 | A1 | * | 5/2000 | ..... B65H 3/0825 |
| DE | 102021209221 | A1 | * | 2/2023 | |
| JP | H09290948 | A | | 11/1997 | |
| JP | 10316267 | A | * | 12/1998 | |
| JP | H10316267 | A | | 12/1998 | |
| JP | 6674818 | B2 | | 4/2020 | |
| KR | 20140111431 | A | * | 9/2014 | |
| WO | WO-2019130951 | A1 | * | 7/2019 | ..... B65H 3/08 |

* cited by examiner

【FIG. 5】
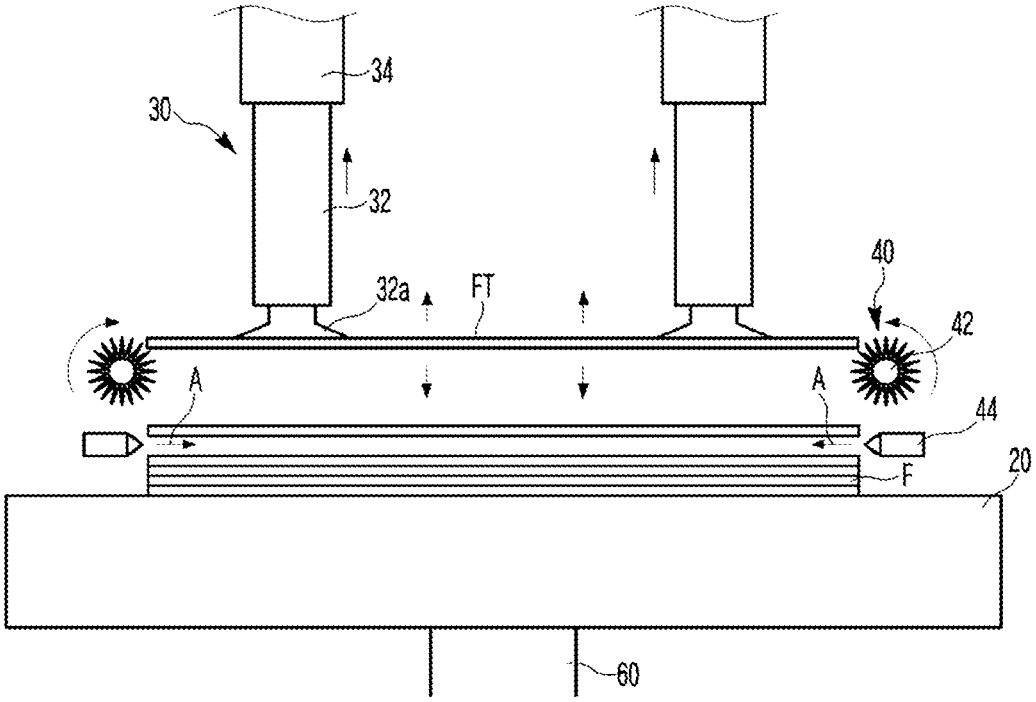

【FIG. 6】
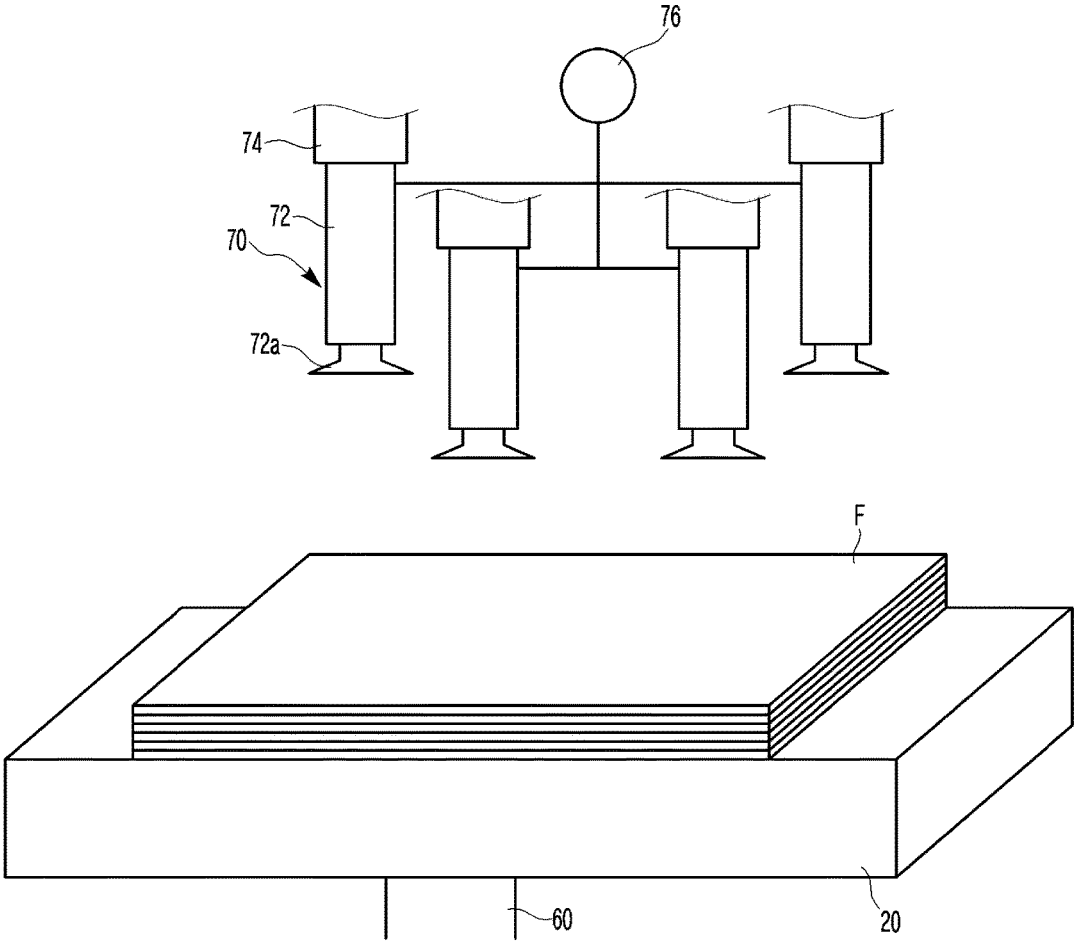

【FIG. 7】
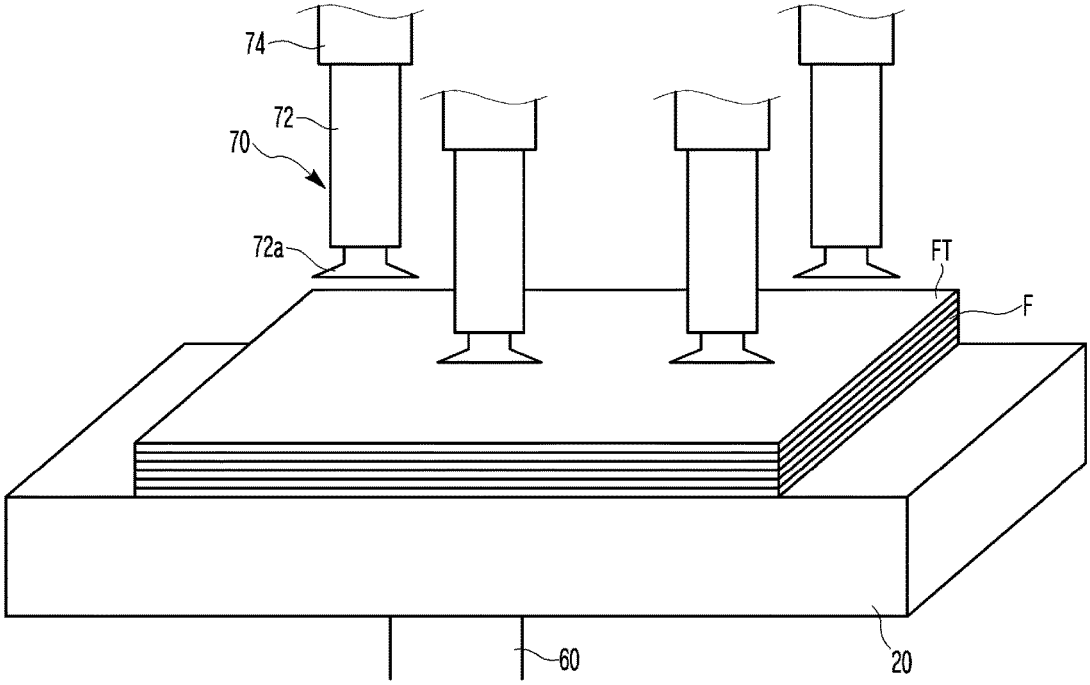

【FIG. 8】
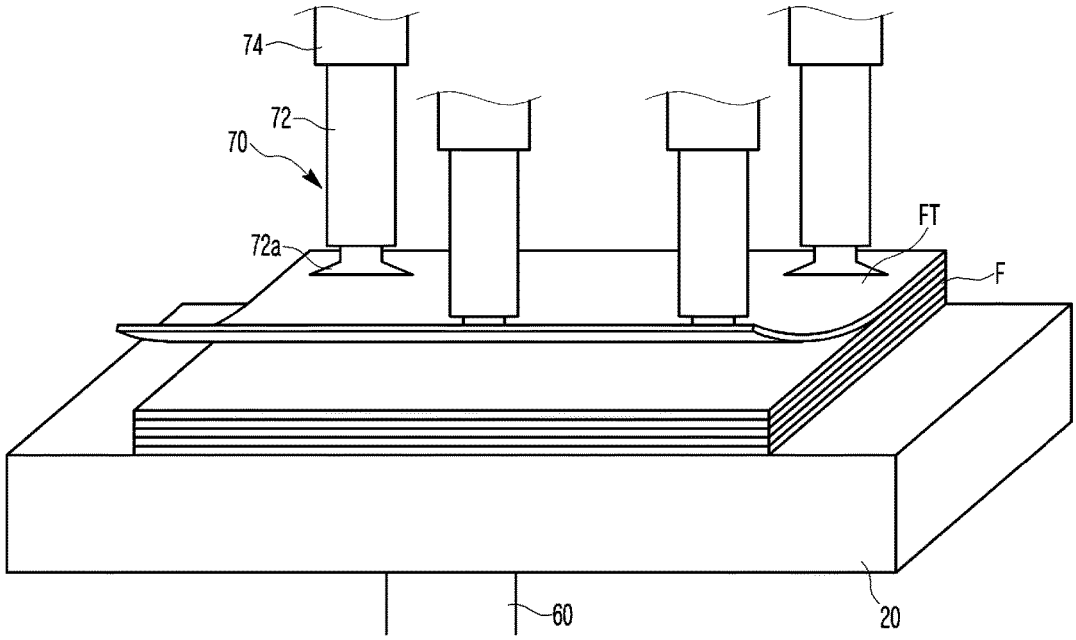

【FIG. 9】
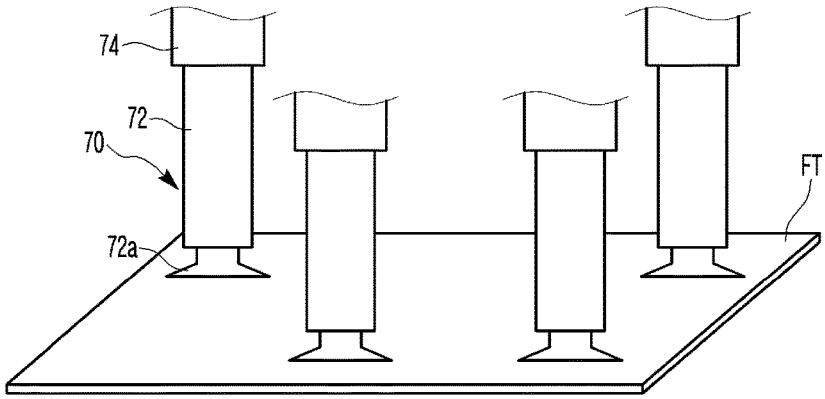
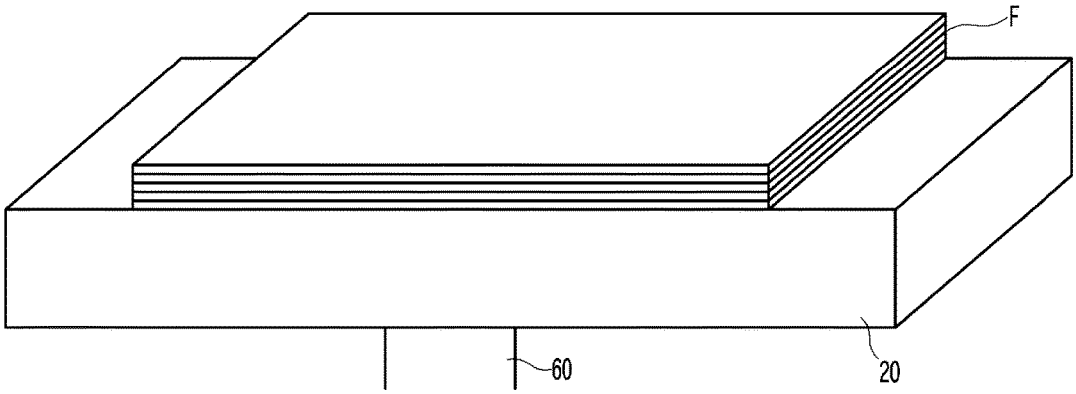

【FIG. 10】
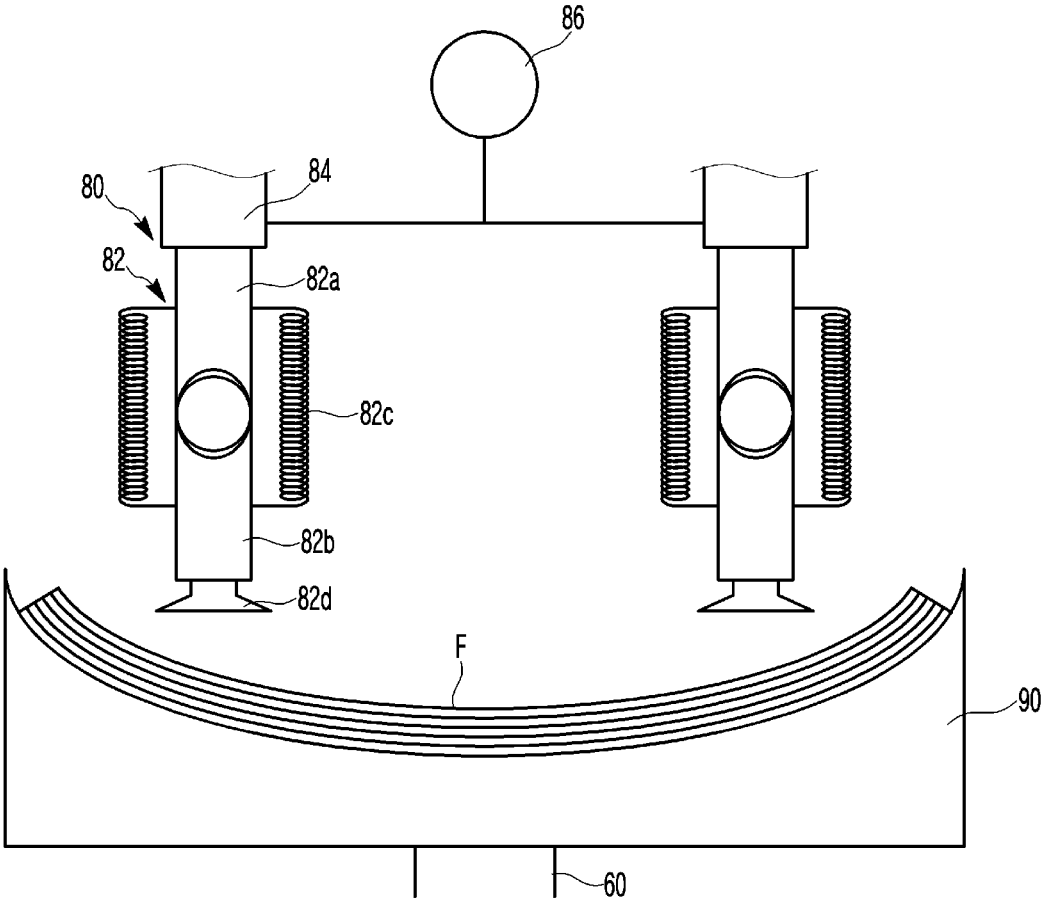

【FIG. 11】
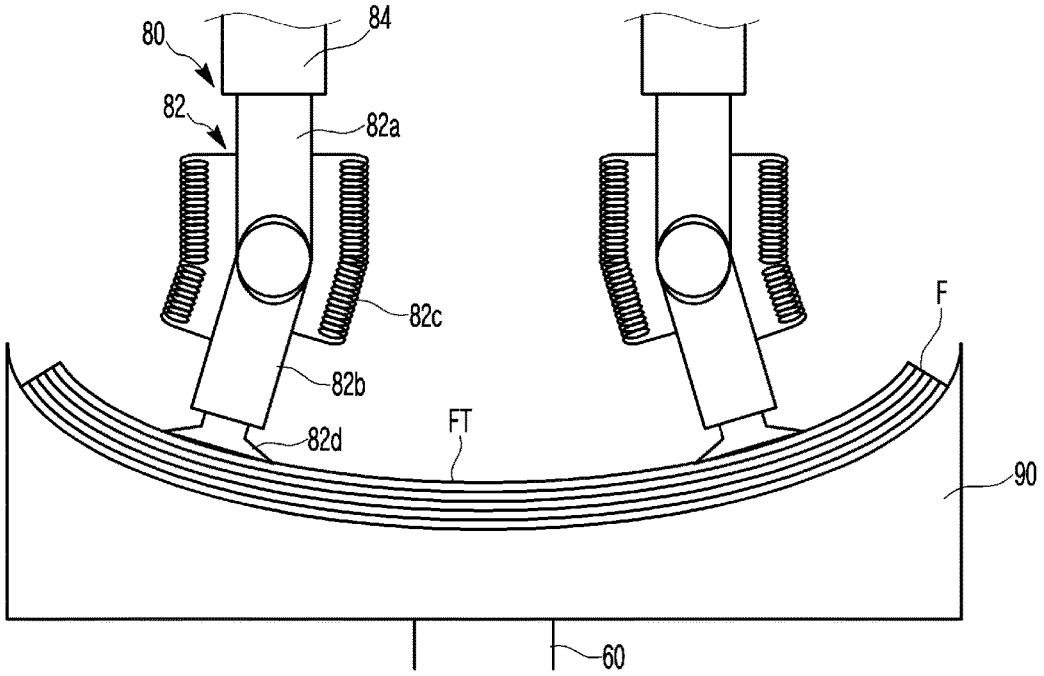

【FIG. 12】
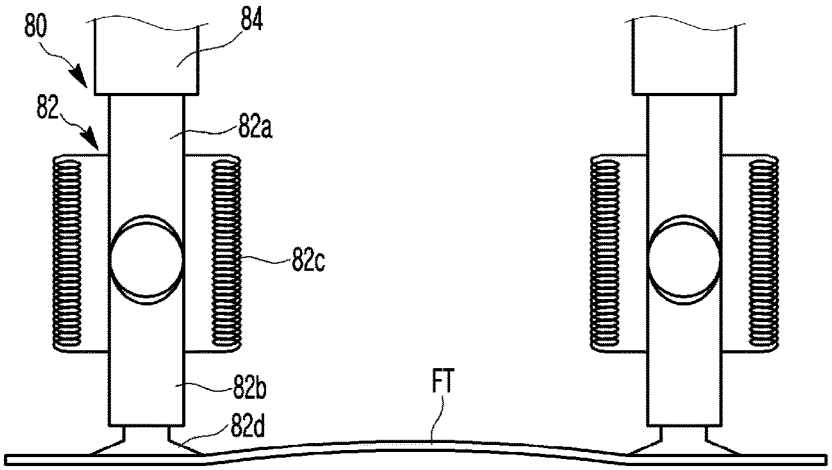
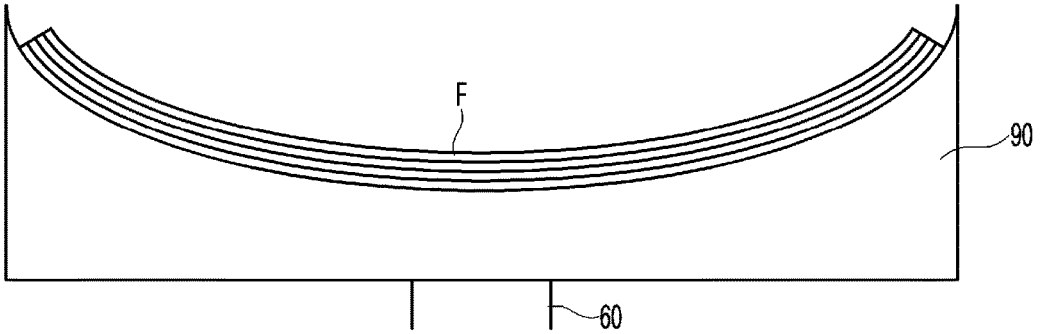

APPARATUS FOR SUPPLYING FILM

CROSS-REFERENCE TO RELATED APPLICATION

This application claims priority to Korean Patent Application No. 10-2020-0047099, filed on Apr. 19, 2020, and Korean Patent Application No. 10-2021-0049385, filed on Apr. 15, 2021, in the Korean Intellectual Property Office, the disclosure of which is incorporated herein by reference.

BACKGROUND OF THE INVENTION

1. Field of the Invention

The present invention relates to an apparatus for feeding a film.

2. Description of the Related Art

A film feeding apparatus is an apparatus for feeding a sheet-shaped film to a film processing device such as a film inspection device or a film cleaning device.

A conventional film feeding apparatus includes a conventional film feeding apparatus using a first method of gripping a film loaded on a film tray using a jig and then dropping the film on the film processing device, and a conventional film feeding apparatus using a second method of putting a film into the film processing device by pushing the film using a roller.

However, the conventional film feeding apparatus using the first method needs to feed the film while the jig repeatedly reciprocates in a section between the film tray and the film processing device, and accordingly, there is a problem of a low film feed rate.

In addition, the conventional film feeding apparatus using the second method has a problem in that, because a film is scratched by a roller during a procedure of pushing the film towards the film processing device using the roller, the quality of the film is degraded or the film is distorted irregularly from side to side and it is difficult to feed the film in the state in which the film is evenly aligned.

When a plurality of films is loaded and stored in multiple layers, two or more films may be stacked while sticking together due to adhesion of the films and static electricity between the films.

However, the conventional film feeding apparatus has no component for separating and feeding two or more films that stick together. Thus, the conventional film feeding apparatus has a problem in that an error occurs in an operation using the film processing device because two or more films are fed while sticking together.

SUMMARY OF THE INVENTION

Therefore, the present invention has been made in view of the above problems, and it is an object of the present invention to provide a film feeding apparatus having an improved structure for rapidly feeding a film.

It is another object of the present invention to provide a film feeding apparatus having an improved structure for preventing a film from being damaged during a procedure of feeding the film.

It is a further object of the present invention to provide a film feeding apparatus having an improved structure for feeding the film in the state in which the film is evenly aligned.

It is yet another object of the present invention to provide a film feeding apparatus having an improved structure for separating and feeding films that stick together.

In accordance with the present invention, the above and other objects can be accomplished by the provision of a film feeding apparatus including a turntable including a driving member and a rotation bar having a central part shaft-coupled to a rotating shaft of the driving member to be driven to rotate around the rotating shaft and driven to rotate to repeatedly perform an operation in which the rotation bar rotates by a predetermined reference angle through the driving member and is then stopped for a predetermined reference time, a film tray that is installed in a predetermined first operation region to position one of opposite ends of the rotation bar on the film tray in a state in which the rotation bar is stopped for the reference time and on which a plurality of films are located in multiple layers, gripping units coupled to the opposite ends of the rotation bar, respectively, to transfer the films along a predetermined circular trajectory around the rotating shaft by the rotation bar and provided to grip the films, and a film ejection unit that is installed in a predetermined second operation region to position a remaining end opposite to the one end of the opposite ends of the rotation bar in the film ejection unit in the state in which the rotation bar is stopped for the reference time and provided to eject the films to an outside, wherein, in the state in which the rotation bar is stopped for the reference time, a griping unit positioned in the first operation region among the gripping units grips a film from the film tray, and a gripping unit positioned in the second operation region among the gripping units releases a film that is pre-gripped from the film tray and transfers the film to the film ejection unit.

The reference angle may be 180°, and the first operation region and the second operation region may be determined to be spaced apart from each other by the reference angle based on the rotating shaft.

The gripping unit may be provided to selectively grip an uppermost film loaded at an uppermost layer among the films loaded on the film tray.

The film feeding apparatus may further include a multiple feed prevention unit configured to separate the film gripped by the gripping unit from the uppermost film while being stuck on the uppermost film among the films.

The multiple feed prevention unit may include at least one brush installed to sweep a film transferred while being gripped by the gripping unit and configured to separate a film stuck on the uppermost film from the uppermost film.

The brush may be installed to sweep an end of the film transferred while being gripped by the gripping unit towards the film tray to load the film separated from the uppermost film on the film tray again.

The multiple feed prevention unit may include at least one air nozzle installed to inject air towards the film transferred while being gripped by the gripping unit and configured to separate the film stuck on the uppermost film from the uppermost film.

The gripping unit may include a vacuum tube installed to face the uppermost film among the films loaded on the film tray and configured to vacuum-adsorb the uppermost film and to selectively grip the uppermost film, and a transfer member configured to raise and lower the vacuum tube.

The plurality of vacuum tubes may be installed at a predetermined interval, and the plurality of transfer members is installed to raise and lower any one of the vacuum tubes.

The gripping unit positioned in the first operation region may vacuum-adsorb the uppermost film through the vacuum tubes step by step over multiple times to vacuum-adsorb the uppermost film by some of the vacuum tubes and to then vacuum-adsorb the uppermost film by some other of the vacuum tubes.

The film tray may have an upper surface having a concave structure recessed by a predetermined curvature to load the films on the upper surface of a corresponding film tray in a state in which the films are concavely bent by the predetermined curvature, and each of the vacuum tubes may include a first vacuum tube to which vacuum pressure is applied, a second vacuum tube configured to receive the vacuum pressure from the first vacuum tube, hinged to the first vacuum tube to surface-contact the uppermost film while hinge-rotating when coming into contact with the uppermost film, and configured to grip the uppermost film, and an elastic member configured to elastically connect the first vacuum tube and the second vacuum tube to elastically restore the first vacuum tube and the second vacuum tube to a predetermined reference arrangement.

The elastic member may include a coil spring having one end coupled to the first vacuum tube and a remaining end that is opposite to the one end and is coupled to the second vacuum tube.

The plurality of elastic members may be installed to be symmetrical.

The turntable may further include one pair of coupling bars coupled to opposite ends of the rotation bar, respectively, and each of the gripping units may be coupled to any one of the coupling bars.

Each of the coupling bars may be coupled to one end of the rotation bar to be symmetrical based on the one end of the rotation bar, to which a corresponding gripping unit is coupled, each of the gripping units may be coupled to one end among the opposite ends of the coupling bar to which a corresponding gripping unit is coupled, and one pair of film trays may be installed in the first operation region to make any one of the pair of film trays face one end of the coupling bar and to make another film tray face a remaining end of the coupling bar, opposite to the one end.

The film ejection unit may include a conveyer configured to transfer the accommodated film to an outside while being released from the gripping unit in the second operation region

BRIEF DESCRIPTION OF THE DRAWINGS

The above and other objects, features and other advantages of the present invention will be more clearly understood from the following detailed description taken in conjunction with the accompanying drawings, in which:

FIGS. 3 to 5 are diagrams for explaining a method of gripping a film using a gripping unit;

FIGS. 6 to 9 are diagrams for explaining a method of gripping a film using a second gripping unit; and FIGS. 10 to 12 are diagrams for explaining a method of gripping a film using a third gripping unit.

DETAILED DESCRIPTION OF THE INVENTION

Figure 1:
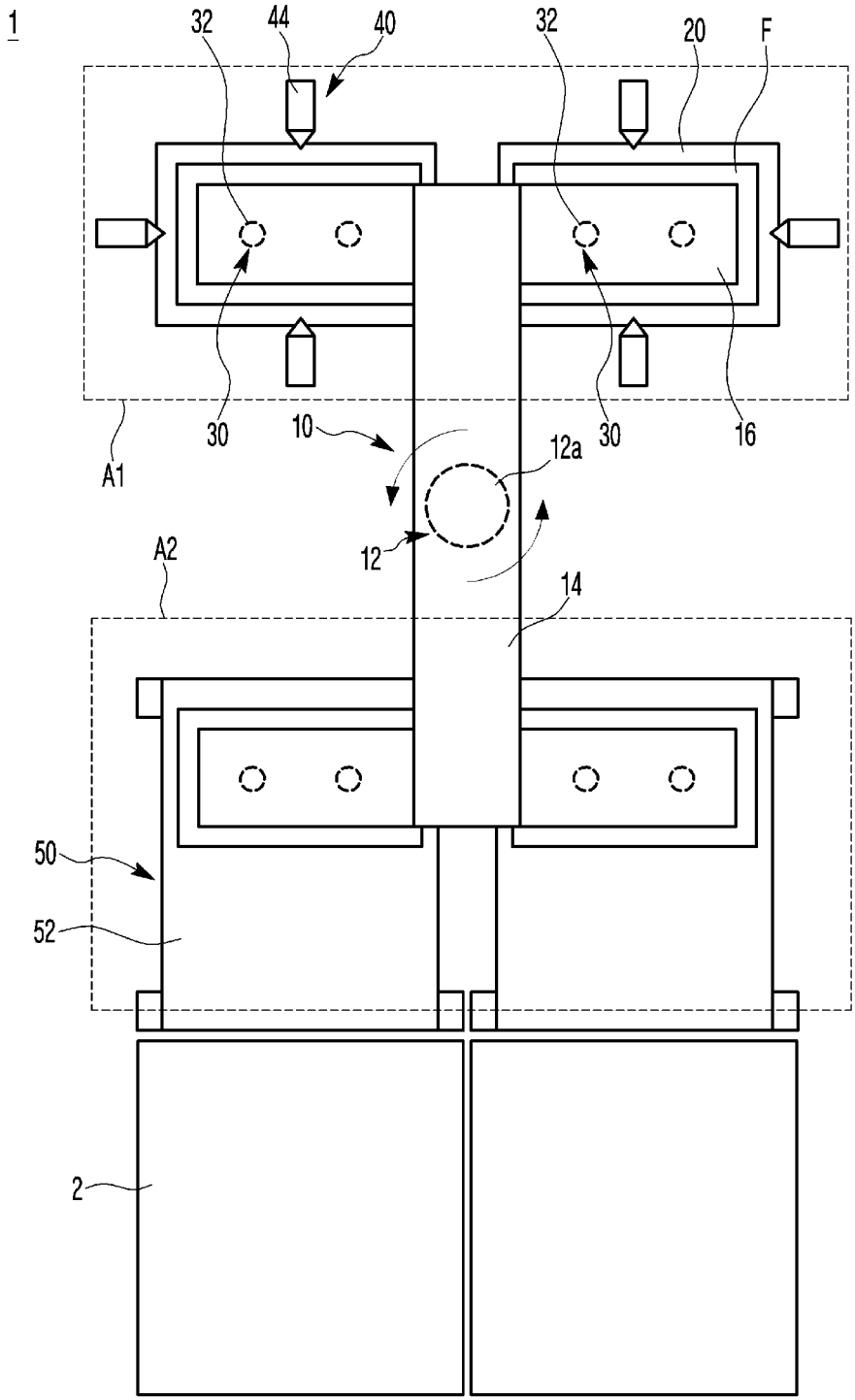
FIG. 1 is a schematic plan view showing the configuration of a film feeding apparatus according to an embodiment of the present invention.

Reference will now be made in detail to the embodiments, examples of which are illustrated in the accompanying drawings. When reference numerals are used to denote elements of the accompanying drawings, it is noted that the same elements have the same numerals as much as possible even if they are indicated in different drawings. In the following description of the present invention, a detailed description of known functions and configurations incorporated herein will be omitted when it may make the subject matter of the present invention unclear.

It will be understood that, although the terms "first", "second", "A", "B", "(a)", "(b)", etc. may be used herein to describe various elements of the present invention, these terms are only used to distinguish one element from another element, and the essential order or sequence of corresponding elements is not limited by these terms. Unless otherwise defined, all terms including technical and scientific terms used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
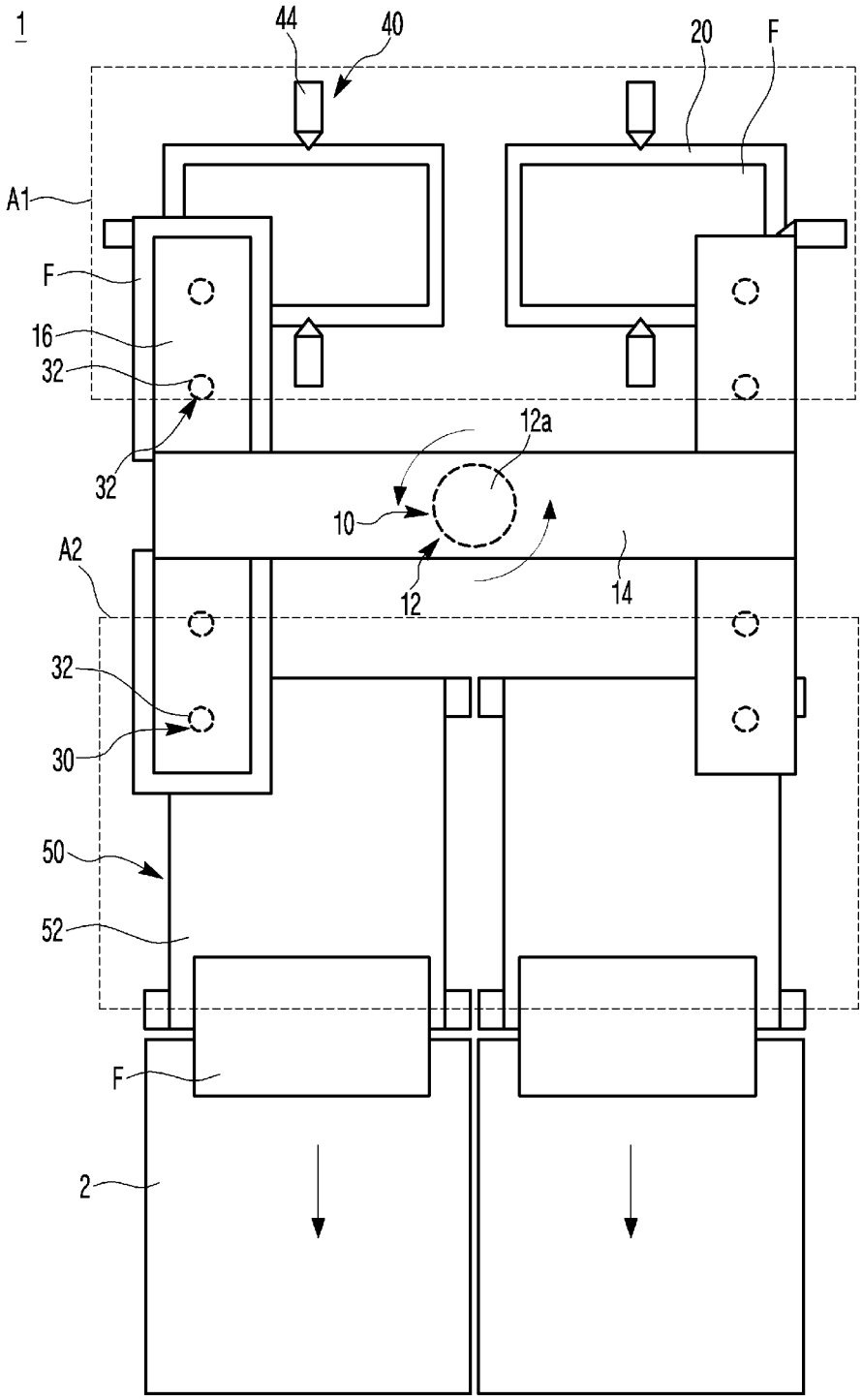
FIG. 2 is a plan view showing the state in which a turntable shown in FIG. 1 is driven to rotate.

FIG. 1 is a schematic plan view showing the configuration of a film feeding apparatus according to an embodiment of the present invention. FIG. 2 is a plan view showing the state in which a turntable shown in FIG. 1 is driven to rotate.

A film feeding apparatus 1 according to an embodiment of the present invention may be an apparatus for feeding a sheet-shaped film having a predetermined area to a film processing device such as a film inspection device or a film cleaning device. Referring to FIG. 1, the film feeding apparatus 1 may include a turntable 10, a film tray 20, a gripping unit 30, a multiple feed prevention unit 40, a film ejection unit 50, and a controller (not shown) for controlling overall driving of the film feeding apparatus 1.

A type of the film F to be feed using film feeding apparatus 1 is not particularly limited. For example, the film F may be a polarized film for manufacturing a display panel.

First, the turntable 10 may be a device for transferring the gripping unit 30 to be described below and the film F gripped by the gripping unit 30. The turntable 10 may include a driving member 12, a rotation bar 14, and a coupling bar 16.

The driving member 12 may be a member for providing driving force for driving the turntable 10. The structure of the driving member 12 is not particularly limited. For example, the driving member 12 may include a driving motor (not shown) for providing driving force, and a reducer (not shown) that is shaft-coupled to the driving motor and reduces and transfers the driving force provided from the driving motor.

The rotation bar 14 may be a member for moving the gripping unit 30 along a predetermined circular trajectory around a rotating shaft 12*a* of the driving member 12 using the driving force provided from the driving member 12. The rotation bar 14 may be shaft-coupled to the driving member 12 to be driven to rotate by the driving member 12. For example, as shown in FIG. 1, a central part of the rotation bar 14 may be shaft-coupled to the rotating shaft 12*a* of the reducer included in the driving member 12 in such a way that the rotation bar 14 is driven to rotate by the driving motor of the driving member 12. Then, as shown in FIG. 2, the rotation bar 14 may be driven to rotate around the rotating shaft 12*a*.

The coupling bar 16 may be a member for coupling the gripping unit 30 to the rotation bar 14 to drive the gripping unit 30 to rotate along the rotation bar 14. The coupling bar 16 may be coupled to the rotation bar 14 to drive the driving member 12 to rotate along the rotation bar 14 when the driving member 12 is driven to rotate. Then, when the driving member 12 is driven, the gripping unit 30 coupled to the coupling bar 16 may be moved along a circular trajectory corresponding to the diameter of the rotation bar 14.

The number of the installed coupling bars 16 is not particularly limited. For example, as shown in FIG. 1, one pair of coupling bars 16 may be installed.

As shown in FIG. 1, the one pair of coupling bars 16 may be respectively coupled to opposite ends of the rotation bar 14 to be symmetrical based on the rotating shaft 12*a*. That is, the one pair of coupling bars 16 may be coupled to the rotation bar 14 to be spaced apart from each other at an angle interval of 180° based on the rotating shaft 12*a*. In this case, a central part of each of the coupling bars 16 may be coupled to one end of the rotation bar 14 in such a way that the coupling bar 16 is symmetrical based on one end of the rotation bar 14, to which the corresponding coupling bar 16 is coupled, but the present invention is not limited thereto. In particular, the coupling bars 16 may be perpendicularly installed to the rotation bar 14, but the present invention is not limited thereto.

As shown in FIG. 2, the coupling bars 16 may be simultaneously driven to rotate along the rotation bar 14 or may be stopped while being symmetrical based on the rotating shaft 12*a*. To this end, the driving member 12 may be driven to repeatedly perform an operation in which the rotation bar 14 and the coupling bars 16 coupled thereto rotate around the rotating shaft 12*a* by a predetermined reference angle and are then stopped for a predetermined reference time. For example, when one pair of coupling bars 16 is coupled to the rotation bar 14 to be spaced apart from each other at an angle interval of 180° based on the rotating shaft 12*a*, the driving member 12 may be driven to repeatedly perform an operation in which the rotation bar 14 and the coupling bars 16 coupled thereto simultaneously rotate around the rotating shaft 12*a* by 180° and are then simultaneously stopped for a predetermined reference time. The reference time is not particularly limited and may be determined to ensure an appropriate time to perform an operation of gripping the film F loaded on the film tray 20 to be described below using the gripping unit 30 to be described below.

As such, when the driving member 12 is driven, whenever the rotation bar 14 and the one pair of coupling bars 16 coupled thereto simultaneously rotate by 180° and are then stopped for a predetermined reference time, the positions of the one pair of coupling bars 16 and the gripping units 30 coupled thereto may be reversed.

For convenience of description, hereinafter, a region that is set at one side of the turntable 10 so as to position the coupling bar 16 coupled to one end of the rotation bar 14 among the one pair of coupling bars 16 when the rotation bar 14 simultaneously rotates around the rotating shaft 12*a* by 180° and is then stopped for the reference time, as shown in FIG. 1, will be referred to as a first operation region A1. In addition, a region that is spaced apart from the first operation region A1 at an angle interval of 180° based on the rotating shaft 12*a* and is set at the other side of the turntable 10, opposite to the one side of the turntable 10, so as to position the coupling bar 16 coupled to the other end of the rotation bar 14, opposite to the one end, among the one pair of coupling bars 16 when the rotation bar 14 simultaneously rotates around the rotating shaft 12*a* by 180° and is then stopped for the reference time will be referred to as a second operation region A2.

Figure 3:
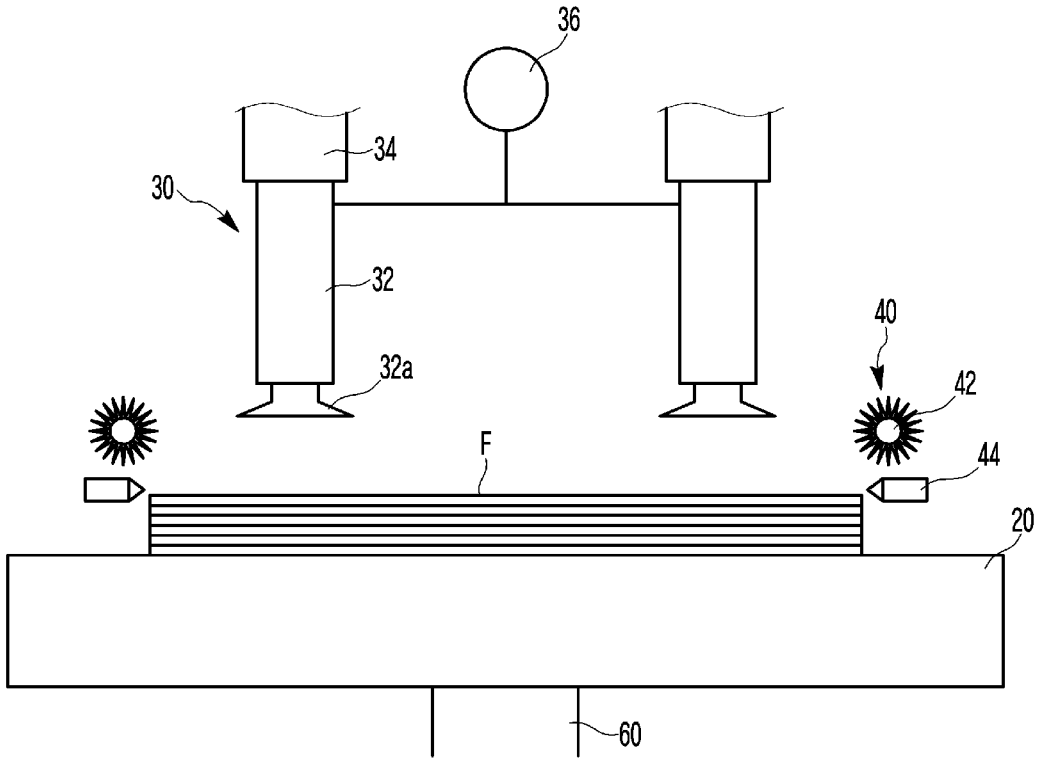
Figure 4:
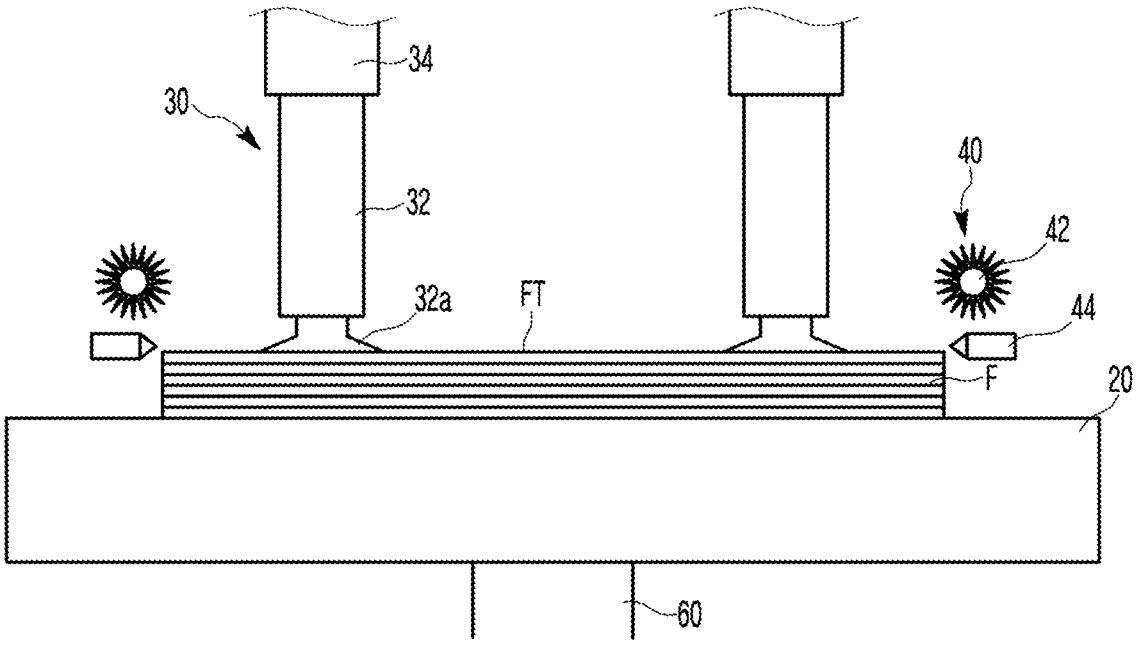

FIGS. 3 to 5 are diagrams for explaining a method of gripping a film using a gripping unit.

Then, the film tray 20 may be a device on which the films F are loaded in order to feed the same using the film feeding apparatus 1. The film tray 20 may be installed in the first operation region A1 to face the coupling bar 16 installed in the first operation region A1 among the one pair of coupling bars 16.

The number of the installed film trays 20 is not particularly limited. For example, as shown in FIG. 1, when the coupling bars 16 are installed to be symmetrical based on one end of the rotation bar 14, one pair of film trays 20 may be installed in the first operation region A1. In this case, any one of the film trays 20 may be installed at one side of the first operation region A1 to face the gripping unit 30 coupled to one end among opposite ends of the coupling bar 16, and the other one of the film trays 20 may be installed at the other side of the first operation region A1, opposite to the one side of the first operation region A1, to face the gripping unit 30 coupled to the other end opposite to the one end among opposite ends of the coupling bar 16.

As shown in FIG. 3, the plurality of films F to be fed using the film feeding apparatus 1 may be loaded in multiple layers in a thickness direction of the film F on each of the one pair of film trays 20.

Each of the one pair of film trays 20 may be coupled to a tray transfer unit 60 for raising and lowering the film trays 20 in the thickness direction of the film F. The structure of the tray transfer unit 60 is not particularly limited. For example, the tray transfer unit 60 may be configured as a cylinder device for raising and lowering the film tray 20. The tray transfer unit 60 may raise and lower the film tray 20 depending on a progress of feeding the film F, the number of the films F loaded on the film tray 20, and so on to maintain the distance between the coupling bar 16 and a film loaded at an uppermost layer (hereinafter referred to as the "uppermost film FT") among the films F loaded on the film tray 20.

Then, the gripping unit 30 may be a device for gripping or releasing the film F.

The structure of the gripping unit 30 is not particularly limited. For example, the gripping unit 30 may be provided to grip the film F through vacuum adsorption and may be coupled to the coupling bar 16 to be transferred by the rotation bar 14 along a predetermined circular trajectory. In this case, as shown in FIG. 3, the gripping unit 30 may include at least one vacuum tube 32 connected to a vacuum pump 36 and at least one transfer member 34 for raising or lowering any one of the vacuum tubes 32 to be close to the film tray 20 or to be spaced apart from the film tray 20. Each of the vacuum tubes 32 may include the adsorption pad 32*a* installed at one end of the corresponding vacuum tube 32, oriented towards the film tray 20, to facilitate vacuum adsorption of the film F using vacuum pressure applied from the vacuum pump 36. The structure of the transfer members 34 is not particularly limited. For example, each of the transfer members 34 may be configured as a cylinder device for raising and lowering the vacuum tube 32 coupled to the corresponding transfer member 34.

The number of the installed gripping units 30 is not particularly limited. For example, as shown in FIG. 1, the one pair of gripping units 30 may be installed at each of the coupling bars 16. In more detail, as shown in FIGS. 1 and 3, the gripping unit 30 may be installed at each of the opposite ends of the coupling bars 16 in such a way that the films F loaded on the film tray 20 face the adsorption pad 32*a*.

As such, as shown in FIGS. 3 to 5, as the gripping unit 30 is installed, when any one of the coupling bars 16 is disposed in the first operation region A1, each of the one pair of gripping units 30 installed in any one of the coupling bars 16 may be operated to selectively grip the uppermost film FT among the films F loaded on the film tray 20 facing the corresponding gripping unit 30.

In more detail, as shown in FIG. 4, with regard to each of the one pair of gripping units 30 installed in any one of the coupling bars 16, the transfer members 34 may lower the vacuum tubes 32 to make the adsorption pad 32*a* contact the uppermost film FT. Then, the adsorption pad 32*a* may grip the uppermost film FT using vacuum pressure applied from the vacuum pump 36 through vacuum adsorption. Then, as shown in FIG. 5, the transfer members 34 may raise the vacuum tubes 32 to space the uppermost film FT apart from the remaining films F loaded on the film tray 20 by a predetermined distance.

Through this procedure, each of the one pair of gripping units 30 installed at any one of the coupling bars 16 may selectively grip the uppermost film FT loaded on the film tray 20 facing the corresponding gripping unit 30.

Then, the multiple feed prevention unit 40 may be a device for preventing two or more films F from being gripped by the gripping unit 30.

The plurality of films F may be loaded in multiple layers on the film tray 20, and thus two or more films F may be gripped together by the gripping unit 30 while sticking together due to adhesion and static electricity of the film F, or other reasons. As such, when two or more films F are fed while sticking together, an error may occur in a subsequent process to be performed using the film F fed by the film feeding apparatus 1. To overcome this, the film feeding apparatus 1 may include the multiple feed prevention unit 40 for separating the film F stuck on the uppermost film FT from the uppermost film FT to selectively grip only one uppermost film FT among the films F that stick together.

The structure of the multiple feed prevention unit 40 is not particularly limited. For example, as shown in FIG. 3, the multiple feed prevention unit 40 may include at least one brush 42 installed to sweep the film F that is transferred while being gripped by the gripping unit 30, and at least one air nozzle 44 installed to inject air A towards the film F that is transferred while being gripped by the gripping unit 30.

The number of the installed brushes 42 is not particularly limited. For example, the plurality of brushes 42 may be installed to contact one end of front, rear, left, and right ends of the film F that is raised while being gripped by the gripping unit 30.

Each of the brushes 42 may be driven to rotate in a predetermined direction by a driving motor (not shown) to sweep an end of the film F, which is raised while being gripped by the gripping unit 30, towards the film tray 20, but the present invention is not limited thereto.

As shown in FIG. 5, when the brushes 42 are used, if two or more films F are gripped together by the gripping unit 30 while sticking together, the remaining films F except for the uppermost film FT that is vacuum-adsorbed directly onto the adsorption pad 32*a* may be separated from the uppermost film FT while being swept towards the film tray 20 by the brushes 42 and may then be loaded on the film tray 20 again.

The number of the installed air nozzles 44 is not particularly limited. For example, as shown in FIG. 5, the plurality of air nozzles 44 may be installed to inject the air A towards an end of one side of front, rear, left, and right ends of the film F that is raised while being gripped by the gripping unit 30.

When the air nozzles 44 are used, if two or more films F are gripped together by the gripping unit 30 while sticking together, an interval between the films F may be generated by the air A injected towards an end of the films F. Thus, the remaining films F except for the uppermost film FT that is vacuum-adsorbed directly onto the adsorption pad 32*a* may be separated from the uppermost film FT by the air A and may then be loaded on the film tray 20 again.

Then, the film ejection unit 50 may be a device for feeding the film F that is transferred to the second operation region A2 from the first operation region A1 by the turntable 10 to a predetermined film processing device 2.

The structure of the film ejection unit 50 is not particularly limited. For example, as shown in FIG. 1, the film ejection unit 50 may include a conveyer 52 installed in the second operation region A2 to eject the film F released from the gripping unit 30 to the outside. In this case, the film processing device 2 may be installed to receive the film F that is ejected out of the film feeding apparatus 1 by the conveyer 52.

The number of the installed conveyers 52 is not particularly limited. For example, as shown in FIG. 1, when the one pair of gripping units 30 are installed in each of the coupling bars 16, the one pair of conveyers 52 may be installed in the second operation region A2. In this case, any one of the conveyers 52 may be installed to face the gripping unit 30 installed at one of opposite ends of the coupling bar 16 positioned in the second operation region A2, and the other one of the conveyers 52 may be installed to face the gripping unit 30 installed at the other end of the opposite ends of the coupling bar 16 positioned in the second operation region A2.

As such, as the conveyers 52 are installed, the film F that is pre-gripped in the first operation region A1 may be accommodated on the conveyer 52 facing the corresponding gripping unit 30 by releasing the film F from any one of the gripping units 30 positioned in the second operation region A2. Correspondingly, the film F that is pre-gripped in the first operation region A1 may be accommodated on the conveyer 52 facing the corresponding gripping unit 30 by releasing the film F from the other one of the gripping units 30 positioned in the second operation region A2.

Each of the conveyers 52 may feed the film F to the predetermined film processing device 2 by transferring the film F transferred from the gripping unit 30, as described above. The type of the film processing device 2 is not particularly limited. For example, the film processing device 2 may be a film inspection device for inspecting Luving Mark, defective Mark, color, bubble, impurities, peeling, dirt, and so on or determining whether a target is defective.

Hereinafter, with reference to the drawings, a method of feeding a film using the film feeding apparatus 1 will be described.

First, as shown in FIG. 1, a controller may drive the rotation bar 14 and the coupling bars 16 coupled thereto to rotate by a predetermined reference angle and may then stop the same for a predetermined reference time using the driving member 12 so as to position any one of the coupling bars 16 in the first operation region A1 and to simultaneously position the other one of the coupling bars 16 in the second operation region A2.

Then, as shown in FIGS. 3 to 5, the controller may grip the uppermost film FT loaded at the uppermost layer through vacuum adsorption to face the corresponding gripping unit 30 among the films F loaded on the film tray 20 using each of the gripping units 30 coupled to the coupling bar 16 positioned in the first operation region A1 in the state in which the rotation bar 14 is stopped for the reference time. Simultaneously, the controller may separate the film F stuck on the uppermost film FT from the uppermost film FT using the multiple feed prevention unit 40 to selectively grip only the uppermost film FT by the gripping unit 30.

As shown in FIG. 1, the controller may accommodate the films F, which are pre-gripped by the gripping units 30 in the first operation region A1, on the conveyers 52 facing the corresponding gripping unit 30 by releasing the films F using the gripping units 30 coupled to the coupling bar 16 positioned in the second operation region A2.

Then, as shown in FIG. 2, the controller may drive the rotation bar 14 and the coupling bars 16 coupled thereto to rotate around the rotating shaft 12*a* by the reference angle using the driving member 12 and may then be stopped for the reference time. Then, the positions of the coupling bars 16 and the gripping units 30 may be reversed by transferring the coupling bar 16 and the gripping units 30 coupled thereto, which are positioned in the first operation region A1, to the second operation region A2 and transferring the coupling bar 16 and the gripping units 30 coupled thereto, which are positioned in the second operation region A2, to the first operation region A1. Simultaneously, the controller may eject the films F transferred from the gripping unit 30 to the outside and may feed the films F to the film processing device 2 using the conveyers 52.

As described above, the film feeding apparatus 1 may simultaneously perform an operation of gripping the film F from the film tray 20 and an operation of feeding the pre-gripped film F from the film tray 20, using the turntable 10. As such, the film feeding apparatus 1 may rapidly feed the films F loaded on the film tray 20 to the film processing device 2.

The film feeding apparatus 1 may grip or release the film F using a vacuum adsorption method, and thus may prevent the film F from being damaged by being swept by a roller or the like during a procedure of transferring the film F and may transfer and feed the film F while constantly aligning the film F.

FIGS. 6 to 9 are diagrams for explaining a method of gripping a film using a second gripping unit.

The film feeding apparatus 1 may include an improved second gripping unit 70 instead of the aforementioned gripping unit 30 in order to separate the films F gripped together with the uppermost film FT from the uppermost film FT while being stuck on the uppermost film FT. That is, the film feeding apparatus 1 may include the second gripping unit 70 that is improved to assist the multiple feed prevention unit 40 or replace the multiple feed prevention unit 40 instead of the aforementioned gripping unit 30.

The second gripping unit 70 may be provided to grip the film F through vacuum adsorption and may be coupled to the coupling bar 16 to be transferred along a predetermined circular trajectory by the rotation bar 14. As shown in FIG. 6, the second gripping unit 70 may include a plurality of vacuum tubes 72 that are spaced apart from each other at a predetermined interval and are connected to a vacuum pump 76, and transfer members 74 for raising or lowering any one of the vacuum tubes 72 to be close to the film tray 20 or to be spaced apart from the film tray 20.

The arrangement of the vacuum tubes 72 is not particularly limited. For example, as shown in FIG. 6, the vacuum tubes 72 may be arranged in two rows.

Hereinafter, with reference to the drawings, a method of gripping the film F using the second gripping unit 70 will be described.

First, the controller may lower some of the vacuum tubes 72 to make an adsorption pad 72*a* included in the corresponding vacuum tubes 72 contact the uppermost film FT loaded on the film tray 20 using the transfer member 74 coupled to some of the vacuum tubes 72. For example, as shown in FIG. 7, the controller may lower the vacuum tubes 72 arranged in any one row to make the adsorption pad 72*a* included in the corresponding vacuum tubes 72 contact the uppermost film FT loaded on the film tray 20 using the transfer member 74 coupled to the vacuum tubes 72 arranged in any one row among the vacuum tubes 72 arranged in two rows.

Then, the controller may primarily vacuum-adsorb the uppermost film FT using the adsorption pad 72*a* included in the corresponding vacuum tubes 72 by selectively applying vacuum pressure to some of the vacuum tubes 72 using the vacuum pump 76. For example, as shown in FIG. 8, the controller may primarily vacuum-adsorb the uppermost film FT using the adsorption pad 72*a* included in the corresponding vacuum tubes 72 by selectively applying vacuum pressure to the vacuum tubes 72 arranged in any one row using the vacuum pump 76.

Then, the controller may lower some of the other vacuum tubes 72 to make the adsorption pad 72*a* included in the corresponding vacuum tubes 72 contact the uppermost film FT using the transfer member 74 coupled to some of the other vacuum tubes 72 among the vacuum tubes 72 in the state in which the uppermost film FT is primarily vacuum-adsorbed by the adsorption pad 72*a* included in some of the other vacuum tubes 72. For example, as shown in FIG. 8, the controller may lower the vacuum tubes 72 arranged in the other one row to make the adsorption pad 72*a* included in the corresponding vacuum tubes 72 contact the uppermost film FT using the transfer member 74 coupled to the vacuum tubes 72 arranged in the other one row among the vacuum tubes 72 arranged in two rows in the state in which the uppermost film FT is primarily vacuum-adsorbed by the adsorption pad 72*a* included in the vacuum tubes 72 arranged in any one row.

Then, the controller may secondarily vacuum-adsorb the uppermost film FT using the adsorption pad 72*a* included in the corresponding vacuum tubes 72 by selectively applying vacuum pressure to some of the other vacuum tubes 72 using the vacuum pump 76. For example, the controller may secondarily vacuum-adsorb the uppermost film FT using the adsorption pad 72*a* included in the corresponding vacuum tubes 72 by selectively applying vacuum pressure to the vacuum tubes 72 arranged in the other one row using the vacuum pump 76.

Then, as shown in FIG. 9, the controller may raise all the vacuum tubes 72 and the uppermost film FT gripped by all the vacuum tubes 72 using all the transfer members 74 to be spaced apart from the remaining films F loaded on the film tray 20.

As described above, the second gripping unit 70 may grip the uppermost film FT through vacuum adsorption step by step over multiple times. Then, the uppermost film FT may vibrate due to vacuum pressure applied through the adsorption pad 72*a* whenever the uppermost film FT is vacuum-adsorbed using some of the vacuum tubes 72. When the second gripping unit 70 is used, the films F stuck on the uppermost film FT may be effectively separated from the uppermost film FT and may be loaded on the film tray 20 again by repeatedly vibrating the uppermost film FT and the films F stuck on the uppermost film FT multiple times.

FIGS. 10 to 12 are diagrams for explaining a method of gripping a film using a third gripping unit.

The film feeding apparatus 1 may include an improved third gripping unit 80 using a different method from that of the aforementioned second gripping unit 70 instead of the aforementioned second gripping unit 70 in order to prevent the plurality of films F from being fed.

The third gripping unit 80 may be provided to grip the film F through vacuum adsorption and may be coupled to the coupling bar 16 to be transferred along a predetermined circular trajectory by the rotation bar 14. The third gripping unit 80 may include at least one vacuum tube 82 that is elastically deformable, and transfer members 84 for transferring any one of the vacuum tubes 82 to be close to the film tray 90 or to be spaced from the film tray 90.

The structure of the vacuum tubes 82 is not particularly limited. For example, as shown in FIG. 10, each of the vacuum tubes 82 may include a first vacuum pipe 82*a* connected to a vacuum pump 86 to apply vacuum pressure thereto, a second vacuum pipe 82*b* having one end hinged to the first vacuum pipe 82*a* to receive the vacuum pressure from the first vacuum pipe 82 and the other end opposite to the one end, at which an adsorption pad 82*d* is installed, and an elastic member 82*c* for elastically connecting the first vacuum pipe 82*a* and the second vacuum pipe 82*b* to elastically restore the first vacuum pipe 82*a* and the second vacuum pipe 82*b* to a predetermined reference arrangement.

The reference arrangements of the first vacuum pipe 82*a* and the second vacuum pipe 82*b* are not particularly limited. For example, as shown in FIG. 10, the reference arrangement of the first vacuum pipe 82*a* and the second vacuum pipe 82*b* may correspond to a straight line.

The elastic member 82*c* may have one end coupled to the first vacuum pipe 82*a* and the other end opposite to the one end, which is configured as a coil spring coupled to the second vacuum pipe 82*b*, but the present invention is not limited thereto. The number of the installed elastic member 82*c* is not particularly limited. For example, a plurality of elastic members 82*c* may be coupled to the vacuum tube 82 to be symmetrical.

Referring to FIG. 10, as described above, in response to provision of the vacuum tube 82, an upper surface of the film tray 90 may have a concave structure that is recessed by a predetermined curvature. Then, the films F may be loaded on the upper surface of the film tray 90 while being concavely bent to correspond to the curvature of the upper surface of the film tray 90.

Hereinafter, with reference to the drawings, a method of griping the film F using the third gripping unit 80 will be described.

First, as shown in FIG. 11, the controller may lower the vacuum tubes 82 to make the adsorption pad 82*d* included in each of the vacuum tubes 82 contact the uppermost film FT using the transfer members 84. Then, as shown in FIG. 11, each of the second vacuum pipes 82*b* may be hinge-rotated by reaction force that is applied while the adsorption pad 82*d* comes into surface-contact with the uppermost film FT.

Then, the controller may vacuum-adsorb the uppermost film FT using the adsorption pad 82*d* included in each of the vacuum tubes 82 by applying vacuum pressure to each of the vacuum tubes 82 using the vacuum pump 86.

Then, as shown in FIG. 12, the controller may raise the vacuum tubes 82 and the uppermost film FT gripped by the vacuum tubes 82 to be spaced apart from the remaining films F loaded on the film tray 90 using the transfer members 84. Then, each of the second vacuum pipes 82*b* may be elastically restored to configure a straight line with respect to the first vacuum pipe 82*a* by elastic force applied from the elastic member 82*c*.

However, the uppermost film FT and the films F stuck on the uppermost film FT may be vacuum-adsorbed to the adsorption pads 82*d* while being concavely bent to have a similar curvature to that of the film tray 90. Thus, as shown in FIG. 12, when each of the second vacuum pipes 82*b* is elastically restored, the uppermost film FT and the films F stuck on the uppermost film FT may vibrate to be flat or be concavely bent by elastic force transferred during a procedure of elastically restoring the second vacuum pipes 82*b*. Then, the films F gripped by the third gripping unit 80 while being stuck on the uppermost film FT may be separated from the uppermost film FT by vibration and may then be loaded on the film tray 90 again.

The present invention relates to a film feeding apparatus and may have the following effects.

First, according to the present invention, an operation of gripping a film from a film tray and an operation of transferring the pre-gripped film to a conveyer from the film tray may be simultaneously performed using a turntable. As such, according to the present invention, the film loaded on the film tray may be rapidly fed to a film processing device.

Second, according to the present invention, the film may be gripped and fed using a vacuum adsorption method, and thus the film may be prevented from being scratched due to a roller or the like during a procedure of feeding the film and may be fed while being evenly aligned.

Third, according to the present invention, when a plurality of films is gripped together by a gripping unit while sticking together, the films that stick together may be separated from each other using a brush, an air nozzle, or the like or by applying vibration, and accordingly, only one film may be selectively fed.

The above description is merely an exemplary embodiment of the present invention and one of ordinary skill in the art will make various modifications and variations without departing from the essential characteristics of the present invention.

Accordingly, the embodiments disclosed in the present invention are not intended to limit the technical idea of the present invention, but to explain the technical idea, and the scope of the technical idea of the present invention is not limited by these embodiments. The scope of the present invention should be interpreted by the following claims, and all technical ideas within the scope equivalent thereto should be construed as being included in the scope of the present invention.

What is claimed is:

1. A film feeding apparatus comprising:

a turntable including a driving member and a rotation bar having a central part shaft-coupled to a rotating shaft of the driving member to be driven to rotate around the rotating shaft and driven to rotate to repeatedly perform an operation in which the rotation bar rotates by a predetermined reference angle through the driving member and is then stopped for a predetermined reference time;

a film tray disposed in a predetermined first operation region to position one end of opposite ends of the rotation bar on the film tray in a state in which the rotation bar is stopped for the reference time and on which a plurality of films are located in multiple layers;

gripping units coupled to the opposite ends of the rotation bar, respectively, to transfer the films along a predetermined circular trajectory around the rotating shaft by the rotation bar and configured to grip the films; and a film ejection unit disposed in a predetermined second operation region to position another end opposite to the one end of the opposite ends of the rotation bar in the film ejection unit in the state in which the rotation bar is stopped for the reference time and configured to eject the films to an outside, wherein, in the state in which the rotation bar is stopped for the reference time, a griping unit positioned in the first operation region among the gripping units grips a film from the film tray, and a gripping unit positioned in the second operation region among the gripping units releases a film that is pre-gripped from the film tray and transfers the film to the film ejection unit, wherein the gripping unit is configured to selectively grip an uppermost film loaded at an uppermost layer among the films loaded on the film tray, wherein the gripping unit includes a vacuum tube disposed to face the uppermost film among the films loaded on the film tray and configured to vacuum-adsorb the uppermost film and to selectively grip the uppermost film, and a transfer member configured to raise and lower the vacuum tube, wherein a plurality of vacuum tubes are arranged at a predetermined interval, and a plurality of transfer members are arranged to raise and lower at least one of the vacuum tubes, wherein the film tray has an upper surface having a concave structure recessed by a predetermined curvature to load the films on an upper surface of a corresponding film tray in a state in which the films are concavely bent by the predetermined curvature, and wherein each of the vacuum tubes includes: a first vacuum pipe to which vacuum pressure is applied; a second vacuum pipe configured to receive the vacuum pressure from the first vacuum pipe, hinged to the first vacuum pipe to surface-contact the uppermost film while hinge-rotating when coming into contact with the uppermost film, and configured to grip the uppermost film; and an elastic member configured to elastically connect the first vacuum pipe and the second vacuum pipe to elastically restore the first vacuum pipe and the second vacuum pipe to a predetermined reference arrangement.

2. The film feeding apparatus of claim 1, wherein:

the reference angle is 180°; and the first operation region and the second operation region are spaced apart from each other by the reference angle around the rotating shaft.

3. The film feeding apparatus of claim 1, further comprising:

a multiple feed prevention unit configured to separate the film gripped by the gripping unit from the uppermost film while being stuck on the uppermost film among the films.

4. The film feeding apparatus of claim 3, wherein the multiple feed prevention unit includes at least one brush configured to sweep a film transferred while being gripped by the gripping unit and configured to separate a film stuck on the uppermost film from the uppermost film.

5. The film feeding apparatus of claim 4, wherein the at least one brush is configured to sweep an end of the film transferred while being gripped by the gripping unit towards the film tray to load the film separated from the uppermost film on the film tray again.

6. The film feeding apparatus of claim 3, wherein the multiple feed prevention unit includes at least one air nozzle configured to inject air towards the film transferred while being gripped by the gripping unit and configured to separate the film stuck on the uppermost film from the uppermost film.

7. The film feeding apparatus of claim 1, wherein the gripping unit positioned in the first operation region vacuum-adsorbs the uppermost film through the vacuum tubes step by step over multiple times such that some of the vacuum tubes vacuum-adsorb the uppermost film and then some other of the vacuum tubes vacuum-adsorb the uppermost film.

8. The film feeding apparatus of claim 1, wherein the elastic member includes a coil spring having one end coupled to the first vacuum pipe and another end that is opposite to the one end and is coupled to the second vacuum pipe.

9. The film feeding apparatus of claim 8, wherein a plurality of elastic members are arranged to be symmetrical.

10. The film feeding apparatus of claim 1, wherein:

the turntable further includes a pair of coupling bars coupled to the opposite ends of the rotation bar, respectively; and each of the gripping units is coupled to one of the pair of coupling bars.

11. A film feeding apparatus comprising:

a turntable including a driving member and a rotation bar having a central part shaft-coupled to a rotating shaft of the driving member to be driven to rotate around the rotating shaft and driven to rotate to repeatedly perform an operation in which the rotation bar rotates by a predetermined reference angle through the driving member and is then stopped for a predetermined reference time;

a film tray disposed in a predetermined first operation region to position one end of opposite ends of the rotation bar on the film tray in a state in which the rotation bar is stopped for the reference time and on which a plurality of films are located in multiple layers;

gripping units coupled to the opposite ends of the rotation bar, respectively, to transfer the films along a predetermined circular trajectory around the rotating shaft by the rotation bar and configured to grip the films; and a film ejection unit disposed in a predetermined second operation region to position another end opposite to the one end of the opposite ends of the rotation bar in the film ejection unit in the state in which the rotation bar is stopped for the reference time and configured to eject the films to an outside, wherein, in the state in which the rotation bar is stopped for the reference time, a griping unit positioned in the first operation region among the gripping units grips a film from the film tray, and a gripping unit positioned in the second operation region among the gripping units releases a film that is pre-gripped from the film tray and transfers the film to the film ejection unit, wherein the turntable further includes a pair of coupling bars coupled to the opposite ends of the rotation bar, respectively, and each of the gripping units is coupled to one of the pair of coupling bars, wherein each of the coupling bars is coupled to one end of the rotation bar to be symmetrical with respect to the one end of the rotation bar, to which a corresponding coupling bar is coupled, wherein each of the gripping units is coupled to one end among opposite ends of the respective coupling bar to which a corresponding gripping unit is coupled, and wherein a pair of film trays is disposed in the first operation region to make any one of the pair of film trays face one end of the respective coupling bar and to make another film tray face another end of the respective coupling bar, opposite to the one end.

12. The film feeding apparatus of claim 11, wherein the film ejection unit includes a conveyer configured to transfer an accommodated film to an outside while being released from the gripping unit in the second operation region.

* * * * *